US006466183B1

(12) United States Patent
Yamamoto et al.

(10) Patent No.: US 6,466,183 B1
(45) Date of Patent: Oct. 15, 2002

(54) VIDEO DISPLAY APPARATUS AND VIDEO DISPLAY METHOD

(75) Inventors: Masaomi Yamamoto, c/o 18-34, Moegino, Aoha-ku, Yokohama-shi, Kanagawa 227-0011 (JP); Ichiro Yasukura, Tokyo (JP); Tetsuo Maruyama, Tokyo (JP); Yutaka Choji, Kanagawa (JP)

(73) Assignees: Sony Corporation, Tokyo (JP); Masaomi Yamamoto, Kanagawa (JP)

( * ) Notice: Subject to any disclaimer, the term of this patent is extended or adjusted under 35 U.S.C. 154(b) by 0 days.

(21) Appl. No.: 09/454,447

(22) Filed: Dec. 6, 1999

(30) Foreign Application Priority Data

Dec. 7, 1998 (JP) ..... 10-347605
Dec. 7, 1998 (JP) ..... 10-347606

(51) Int. Cl.[7] ..... G09G 5/00
(52) U.S. Cl. ..... 345/1.1; 345/2.1; 352/100
(58) Field of Search ..... 345/1.1, 1.2, 1.3, 345/2.1, 2.2, 2.3, 3.1, 3.2, 3.3, 3.4, 87, 88, 89, 102, 56; 352/100

(56) References Cited

U.S. PATENT DOCUMENTS 5,416,496 A * 5/1995 Wood ..... 345/102
6,016,183 A * 1/2000 Yamamoto ..... 352/100

FOREIGN PATENT DOCUMENTS

EP 0386269 9/1990 ..... G09F/19/12
GB 2241813 9/1991 ..... G09F/19/12
GB 2309112 7/1997 ..... G09F/19/22
WO 9407233 3/1994 ..... G09F/19/22

* cited by examiner

*Primary Examiner*—Xiao Wu
(74) *Attorney, Agent, or Firm*—Jay H. Maioli

(57) ABSTRACT

A video display apparatus with a plurality of display devices arrayed in a line with a predetermined interval at portions which may be watched by passengers on a moving vehicle, a video signal supplying device for supplying a still picture video signal to the plurality of display devices, and an intermittent display control dence for energizing the plurality of display devices simultaneously and controlling a still picture video signal display time and a video display stop time at such an interval as to obtain a clear picture. A video signal which represents successive motions on the whole of a picture as seen from a moving vehicle is supplied to respective display devices. Since a picture is given by an electrical signal, it is sufficient that the contents of the picture may be changed by rewriting the contents of a video memory. Therefore, any pictures may be displayed, and a plurality of pictures may also be displayed. Moreover, a memory device stores a still picture video signal comprising a plurality of programs having contents different from each other. The programs are sequentially selected under control of a control unit, and a still picture video signal corresponding to a selected program is supplied to the display device. Thus, a plurality of pictures whose displayed contents are different from each other may be switched and displayed each time a train, for example, passes the display device.

31 Claims, 14 Drawing Sheets

| PROGRAM LIST | PICTURE CONTENTS OF PROVIDER |
|---|---|
| 01 | COSMETICS |
| 02 | AUTOMOBILE |
| 03 | HAMBURGER |
| ⋮ | ⋮ |
| 06 | COFFEE |
| 07 | WHISKY、BEER |
| 08 | TOBACCO |
| 09 | ELECTRIC MANUFACTURED PRODUCT |

FIG. 10

| DEISPLAY TIME PERIOD | FREQUENCY | PROGRAM LIST | PROGRAM CONTENTS |
|---|---|---|---|
| 07:00<br>20:00 | 1 | 01 | COSMETICS |
| 07:00<br>22:00 | 1 | 02 | AUTOMOBILE |
| 11:00<br>13:00 | 5 | 03 | HAMBURGER |
| ⋮ | ⋮ | ⋮ | ⋮ |
| 17:00<br>20:00 | 7 | 07 | WHISKY、BEER |

VIDEO DISPLAY APPARATUS AND VIDEO DISPLAY METHOD

BACKGROUND OF THE INVENTION

1. Field of the Invention

The present invention relates to a video display apparatus by which passengers on a running or moving vehicle such as a train running on the rails or passengers on an elevator may become able to watch displayed pictures as successive moving pictures (real moving pictures) or still pictures.

2. Description of the Related Art

Heretofore, this kind of video display apparatus, e.g. video display apparatus for successive moving pictures by which passengers may watch displayed pictures as real moving pictures comprises a plurality of still picture display devices arrayed in a line at a predetermined interval on the wall surface stretched along the running direction of the running path in which a moving vehicle with passengers getting thereon is running, the plurality of still picture display devices capable of displaying still pictures as successive pictures when the still pictures are seen as a whole picture and a flashing illumination device capable of simultaneously flashing and illuminating these still pictures.

Japanese laid-open patent application No. 5-27197 (reference cited 1), for example, describes an arrangement which comprises a plurality of still pictures arrayed in a line at a predetermined interval on the wall stretched along the running direction of the track so as to represent sequential and successive motions.

Japanese laid-open patent application No. 2-201489 (reference cited 2) describes a technique in which a video signal is displayed by a display device using optical fibers and in which the displayed video signal is moved following a train.

Japanese laid-open patent application No. 7-104693 (reference cited 3) describes a display apparatus using light-emitting display means to display a real moving picture by arranging still pictures in a line or a character display apparatus which may be movable at the same speed as that of a train. Also, Japanese laid-open patent application No. 7-104693 describes the light-emitting display means which is energized in a short period of time.

Of the above-mentioned plurality of the related-art techniques, according to the above-mentioned related-art technique disclosed in the reference cited 1, when images which represent successive motions are changed, still pictures have to be changed manually. This work is cumbersome, involves some risk, and is also troublesome for a user. Moreover, when such a picture is displayed within a tunnel, it is to be noted that it is impossible to change the contents of the still pictures at every train because the work for changing the contents of the still pictures involves some risk.

The related-art technique disclosed in the reference cited 2 targets the mode in which display characters are moved like an electric news tape. However, the related-art technique disclosed in the reference cited 2 does not disclose a technique in which passengers become able to watch real moving pictures by supplying sequentially successive still pictures.

Furthermore, according to the related-art technique disclosed in the reference cited 3, there arises a problem such that a running speed of a train has to be constantly detected in order to display characters. Also, the above-mentioned reference cited 3 describes only the light-emitting display means which may be energized in a short period of time when a real moving picture is displayed. However, the reference cited 3 does not describe or suggest concretely a light-emitting time during which the above-mentioned light-emitting display means is energized. The light-emitting time of the light-emitting display means becomes an extremely important factor for realizing more natural and clear successive moving pictures or still pictures which may be viewed as still pictures by viewers (passengers).

SUMMARY OF THE INVENTION

It is an object of the present invention to provide a video display apparatus in which a plurality of natural and clear successive moving pictures or still pictures may be viewed from a moving vehicle with passengers getting thereon, a series of still pictures representing successive motions whose video sources may be changed with ease in a short period of time and in which display video signals corresponding to a plurality of programs whose displayed contents are different from each other may be displayed in accordance with a desired schedule.

According to an aspect of the present invention, there is provided a video display apparatus which is comprised of a plurality of display devices arrayed in a line with a predetermined interval at portions which may be watched by passengers getting on a moving vehicle, a video signal supplying device for supplying a still picture video signal to the plurality of display devices, and an intermittent display control means for energizing the plurality of display devices simultaneously and making a display time of the still picture video signal displayed on the plurality of display devices become shorter than a video display stop time.

According to another aspect of the present invention, there is provided a video display method which is comprised of the steps of generating a plurality of still pictures which are sequentially displayed to represent successive motions, storing the plurality of still pictures generated at the preceding step in a memory device, and intermittently displaying the plurality of stored still pictures in respective corresponding display devices, wherein the intermittent display step is characterized in that $100t1<t2$ where $t1$ is the video display time and $t2$ is the video display stop time.

According to still another aspect of the present invention, there is provided a video display apparatus which is comprised of a plurality of liquid-crystal display devices arrayed in a line with a predetermined interval at portions which may be watched by passengers getting on a moving vehicle, a video signal supplying device for supplying a still picture video signal to the plurality of liquid-crystal display devices, a light source for energizing the plurality of liquid-crystal display devices, and a light-source flashing control means for controlling the flashing of the light source, wherein the video signal supplying apparatus include a random-access memory (RAM) for storing the still picture video signal.

According to a further aspect of the present invention, there is provided a video display apparatus which is comprised of a plurality of display devices arrayed in a line with a predetermined interval at portions which may be watched by passengers getting on a moving vehicle, a still picture video signal memory means for supplying a still picture video signal to the plurality of display devices, a control means for controlling the still picture video signal memory means, a detection means for detecting whether or not the moving vehicle is placed at the portion in which the plurality of display devices are installed, and an illumination device for intermittently displaying the plurality of display devices, wherein the still picture video signal memory device stores a still picture video signal comprising a plurality of programs whose contents are different from each other, the programs are selected under control of the control means, and a still picture video signal corresponding to the selected program is supplied to the display device.

According to a further aspect of the present invention, there is provided a video display apparatus which is comprised of a plurality of display devices arrayed in a line with a predetermined interval at portions which may be watched by passengers getting on a moving vehicle, a still picture video signal memory means for supplying a still picture video signal to the plurality of display devices, a control means for controlling the still picture video signal memory means, a detection means for detecting whether or not the moving vehicle is placed at the portion in which the plurality of display devices are installed, and an illumination device for intermittently displaying the plurality of display devices, wherein the still picture video signal memory device stores a still picture video signal comprising a plurality of programs whose contents are different from each other, the programs are selected under control of the control means, and a still picture video signal supplied to the plurality of display devices is changed at least at the unit of the programs under control of the control means.

In accordance with yet a further aspect of the present invention, there is provided a video display apparatus which is comprised of a plurality of display devices arrayed in a line with a predetermined interval at wall portions which may be watched by passengers getting on a moving vehicle, a still picture video signal memory means for supplying a still picture video signal to the plurality of display devices, a control means for controlling the still picture video signal memory means, and an illumination device for intermittently displaying the plurality of display devices, wherein the still picture video signal memory device stores a still picture video signal comprising a plurality of programs whose contents are different from each other, and the number in which pictures are successively displayed on the display devices is set for every program under control of the control means.

In accordance with still a further aspect of the present invention, there is provided a video display apparatus which is comprised of a plurality of display devices arrayed in a line with a predetermined interval at tunnel wall which may be watched by passengers getting on a moving vehicle, a still picture video signal memory means for supplying a still picture video signal to the plurality of display devices, a control means for controlling the still picture video signal memory means, and an illumination device for intermittently displaying the plurality of display devices, wherein the still picture video signal memory means stores still picture video signals corresponding to a plurality of programs whose contents are different from each other, each of the programs stores data indicative of a display frequency relative to a display time period, and the control means controls the number of each of the programs displayed on the display devices in the display time period based on the display frequency data.

BRIEF DESCRIPTION OF THE DRAWINGS

These and other objects and features of the present invention will become clear from the following description of the preferred embodiments given with reference to the accompanying drawings, in which:

FIG. 10 is an explanatory diagram showing the details of the contents of a memory according to the embodiment of the present invention;

DESCRIPTION OF THE PREFERRED EMBODIMENTS

The embodiments of the present invention will hereinafter be described in detail with reference to the drawings. In the following embodiments, the present invention is applied to a successive moving picture display apparatus by which passengers become able to watch successive moving pictures.

Figure 1:
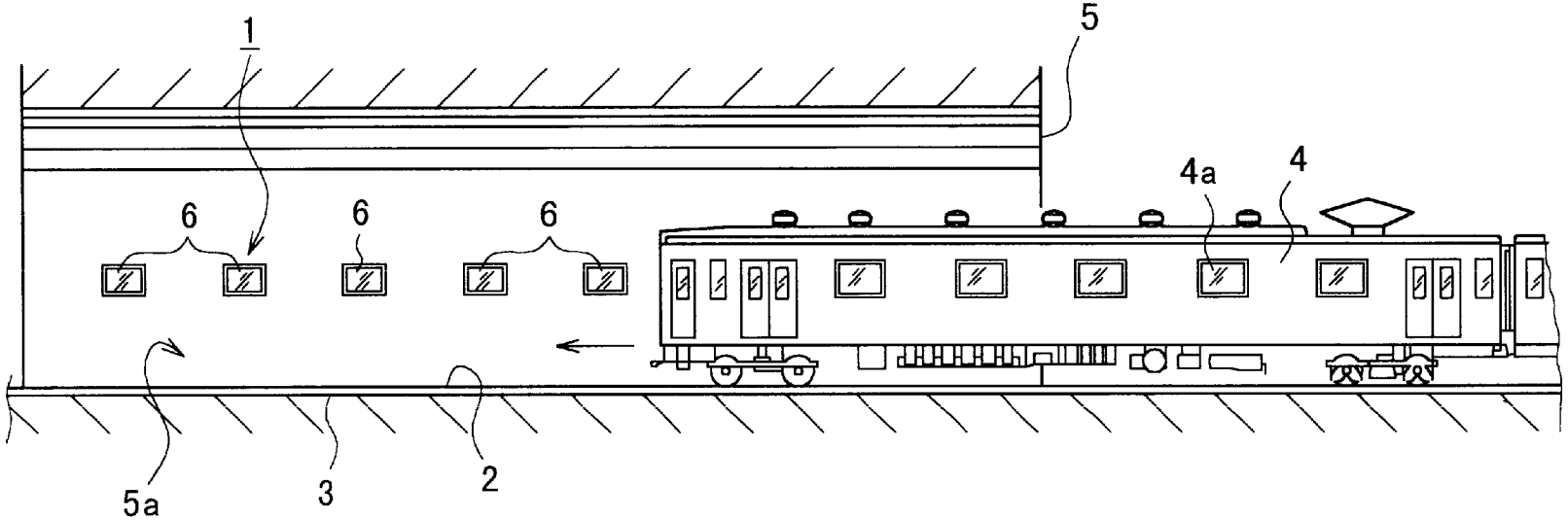
FIG. 1 is an explanatory diagram schematically showing the manner in which a video display apparatus according to the present invention is used within a tunnel.

FIG. 1 is a pictorial representation showing the embodiment to which the present invention is applied. As shown in FIG. 1, a successive moving picture display apparatus 1 comprises a plurality of video display devices 6 arrayed in a line with a predetermined interval at a portion, e.g. a wall 5*a* of a tunnel 5 in which a track 3 is formed, which can be watched by passengers on a moving vehicle running on the track 3 in which rails 2 are laid, e.g. a train 4 through its window 4a. In this embodiment, the display device 6 might be a two-dimensional display device (LED (light-emitting diode) display device) which comprises a plurality of light-emitting diodes (LEDs) arrayed in a matrix-fashion (two-dimensional fashion).

Figure 2:
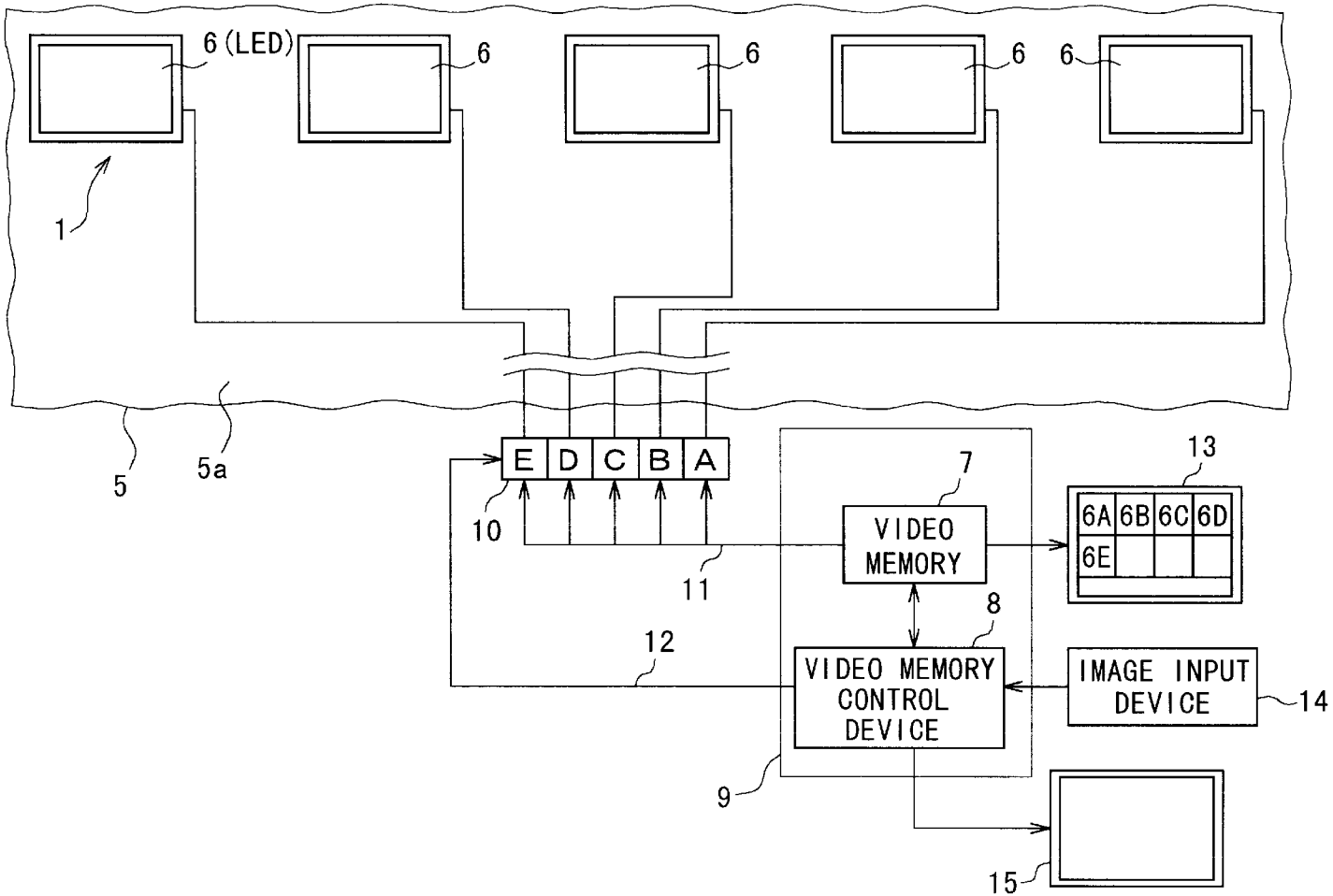
FIG. 2 is a block diagram showing the embodiment in which the present invention is applied to a video display apparatus for displaying successive moving pictures.

FIG. 2 shows in block form the overall arrangement of the successive moving picture display apparatus 1 which supplies still video signals, each of which represents a successive moving picture, to the LED display devices 6. In FIG. 2, elements and parts identical to those of FIG. 1 are marked with the same reference numerals and therefore need not be described.

As shown in FIG. 2, the successive moving picture display apparatus 1 includes a video signal supplying device 9 comprising a video memory 7 for supplying respective still video signals to the LED display devices 6 and a video memory control device 8 for controlling this video memory 7. The successive moving picture display apparatus 1 further includes a buffer memory 10 disposed between this video signal supplying device 9 and the LED display device 6 for supplying a still picture signal from the video memory 7 to a plurality of LED display devices 6 intermittently.

As the video memory 7, there may be used a random-access memory (RAM) and the like. The still picture video signal, which sequentially represents a successive moving picture, from the video signal supplying device 9 using the video memory 7, is a video signal which represents a real moving picture whose motion becomes successive, i.e. step-by-step video signal comprising a so-called animated real moving picture. Accordingly, the above-mentioned still picture video signal is the signal which represents a frame still picture like a movie film.

As shown in FIG. 2, to the video signal supplying device 9 are connected a first monitor 13, a second monitor 15 and an image input device 14. A signal line 12 from the video signal supplying device 9 is connected to the buffer memory 10, thereby controlling the operation of the buffer memory 10.

In the successive moving picture display apparatus 1 thus arranged, the manner in which the still picture signal is stored in the video memory 7 will be described below. As still pictures which sequentially represent successive moving pictures, there will be illustrated still pictures 6A, 6B, 6C, 6D, 6E in which rabbits are jumping as shown in FIG. 3 when the still pictures 6A, 6B, 6C, 6D, 6E are seen from the different windows 4*a* of the train 4.

Figure 3:
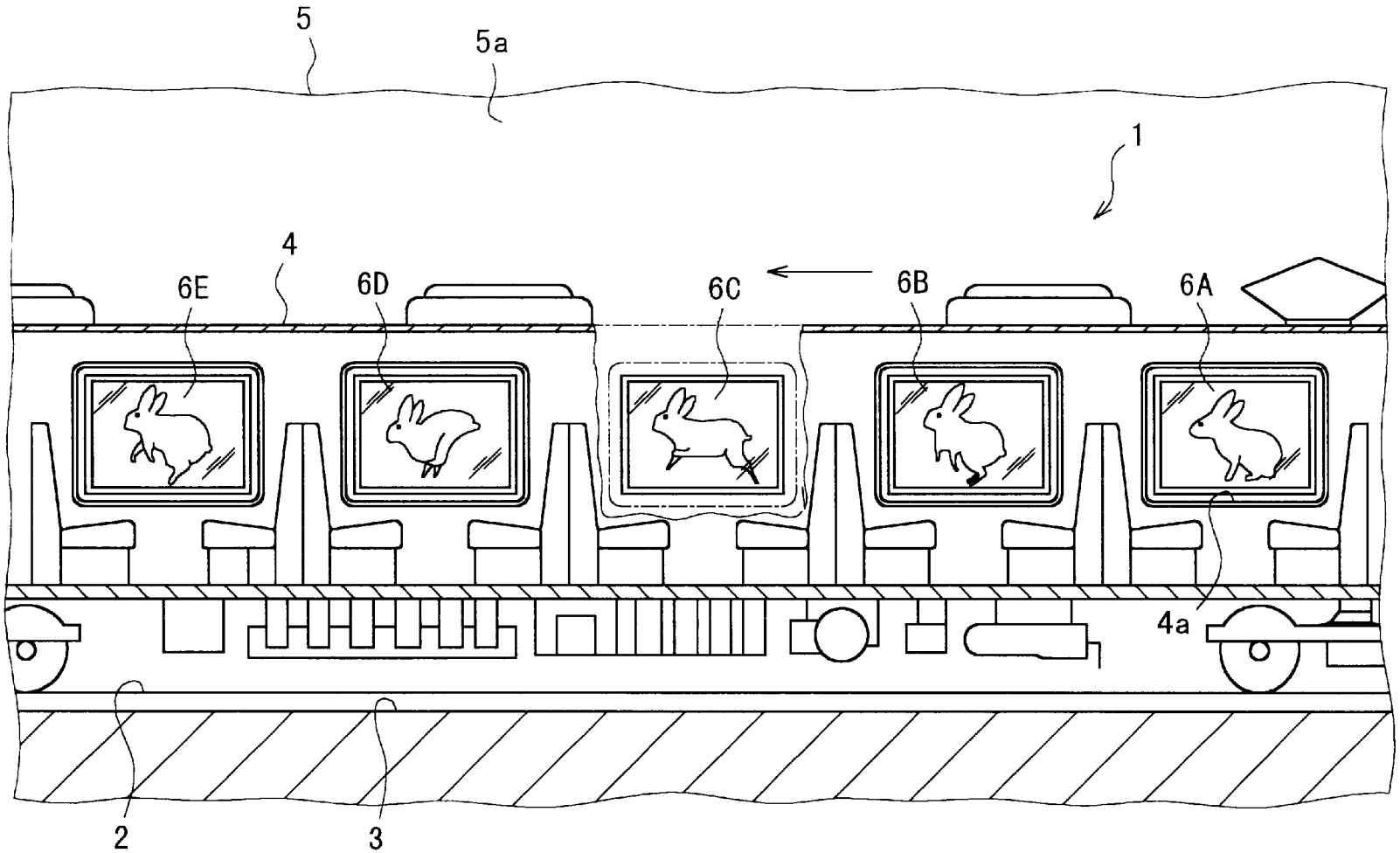
FIG. 3 is an explanatory diagram showing the states in which still pictures are displayed on the windows by a light-emitting diode (LED) display device.

Initially, as shown in FIGS. 2 and 3, the still picture 6A indicative of the rabbit which is going to jump is inputted to the video memory control device 8 from the image input device 14, and this still picture 6A is visually confirmed by the second monitor 15. If it is determined that this still picture 6A should be used, then the address of the video memory 7 is designated, and the still picture 6A is stored in the video memory 7.

Next, the still picture 6B which indicates the next motion of the rabbit is supplied to the video memory control device 8 from the image input device 14, and this still picture 6B is visually confirmed by the second monitor 15. If it is determined that this still picture 6B should be used, then another address of the video memory 7 is designated, and the still picture 6B is stored in the designated address of the video memory 7. In a like manner, the still pictures 6C, 6D and 6E will be sequentially stored in the designated addresses of the video memory 7.

The five still pictures 6A, 6B, 6C, 6D, 6E thus stored in the video memory 7 may be visually confirmed by the multimode display-type monitor 13, for example, at the same time.

The present invention has been described so far with reference to the five still pictures 6A, 6B, 6C, 6D, 6E, for example. Upon actual application of the present invention, if 30 still pictures per second are illustrated as the most popular example, then 90 still pictures are required in order to effect the display of 3 seconds, for example. To simplify the explanation, let us explain the present invention with reference to the above-mentioned five still pictures 6A, 6B, 6C, 6D, 6E.

As the image input device 14 which is used to input still pictures to the video memory control device 8, initially, there may be considered a telecine. The telecine is the device for converting each frame picture of an ordinary movie film into a television signal. The telecine is able to convert a still picture of 24 frames per second into a television signal of 30 frames per second.

Since it is customary that commercial pictures are taken by a silver salt film, the telecine is used as the image input device 14. If a commercial picture is taken by a video camera, then a video tape recorder (VTR) with a still picture playback function is used as the image input device 14. Further, if an original still picture is taken by a VTR exclusively-used to create animation, the VTR itself can be served as the image input device 14. When a real moving picture played back by the VTR is supplied to the video memory control device 8 as it is, a frame synchronizing signal contained in the reproduced video signal may be detected and stored in the video memory 7 at every frame.

The five still pictures 6A, 6B, 6C, 6D, 6E thus stored in the video memory 7 are supplied through a transfer line 11 to the buffer memory 10 under control of the video memory control device 8. The buffer memory 10 includes addresses A, B, C, D, E corresponding to the respective LED display devices 6. Accordingly, the still picture 6A supplied from the video memory 7 is stored in the address A of the buffer memory 10, whereby the still picture 6A is displayed on the rightmost LED display device 6 of the LED display devices 6 shown in FIG. 2. Similarly, respective still pictures will sequentially be supplied from the buffer memory 10 to the respective LED display devices 6 under control of the video memory control device 8.

The manner in which the still pictures are supplied from the buffer memory 10 to the LED display device 6 will be described next. According to the present invention, since it is intended to provide a video display apparatus in which passengers on the train become able to watch real moving pictures by arranging still pictures which sequentially represent successive moving pictures, the LED display device 6 has to display the still picture intermittently. The intermittent display was also disclosed heretofore in the above-mentioned three Japanese laid-open patent applications Nos. 5-27197, 2-201489 and 7-104693 of the related-art examples, and therefore need not be described in detail. The intermittent display of the present invention is particularly different from those of the prior-art examples, and is characterized by a peculiar intermittent display.

Figures 4, 6:
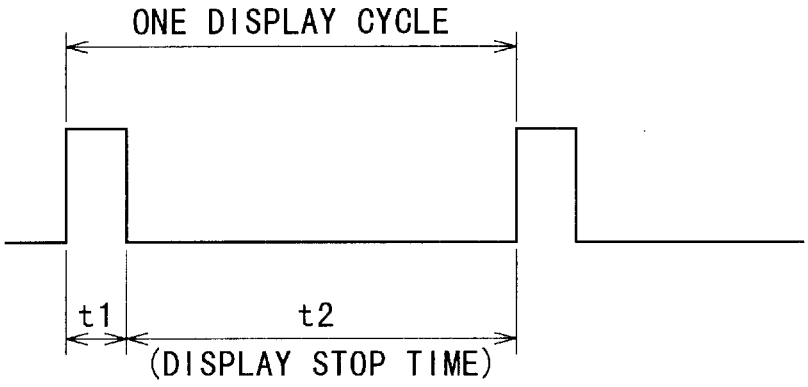
FIG. 4 is a diagram showing a relationship between a still picture display period and a display stop period in the embodiment according to the present invention.
FIG. 6 is an explanatory diagram showing contents of a memory according to the embodiment of the present invention in detail.

That is, according to the present invention, the video memory control device 8 controls the buffer memory 10 such that the still pictures are intermittently supplied to the LED display devices 6 as shown in FIG. 4. Assuming that t1 represents a still picture supply time (display time) and t2 represents a still picture supply stop time, then the LED display device 6 becomes able to intermittently display still pictures so as to satisfy a time relationship expressed as $100t1<t2$.

The video memory control device 8 transmits a control signal (e.g. signal illustrated in FIG. 4) for controlling the operation of the buffer memory 10 through the signal line 12 to the buffer memory 10. In response to the control signal supplied thereto, the buffer memory 10 supplies the still pictures stored in the respective addresses thereof to the corresponding LED display devices 6 during the time t1 simultaneously. Thus, the LED display devices 6 display the respective still pictures at the same time.

During the next time t2, the buffer memory 10 stops the supply of the still pictures to the LED display devices 6. Thus, the LED display devices 6 stop the display of the still pictures, and hence the screen of the LED display device 6 gets dark.

If this operation is executed continuously, then the LED display devices 6 are energized during the time t1 and are de-energized during the time t2, thereby resulting in the flashing display being effected. According to the experiments done by the assignee of the present invention, with respect to the time relationship between t1 and t2, there were obtained most natural, clear and smooth real moving pictures under the conditions in which the time relationship t1 and t2 ranges from 200t1=t2 to 1000t1=t2 depending upon various conditions. If t1 is less than 100t1=t2 (i.e. 100t1>t2), then there could not be obtained satisfactory real moving pictures. The reason for this will be described below. That is, due to man's after-image, if a duration in which a still picture of a certain frame is displayed is long, then when a viewer watches a still picture of the next frame, the viewer is forced to watch the still pictures of these two frames. In actual practice, the displayed image is blurred or watched as a multiple image unavoidably.

In the example of the above-mentioned experiment, it is arranged that, even when the next still picture is displaced by 1 mm, then a still picture is not blurred by the displacement of the next still picture and may be confirmed visually by a viewer. In that case, assuming that the spacing between the display devices is 53 cm when the viewer is traveling at a rate of 60 km/H, then the optimum display time t1 obtained at that time is expressed as t1=(1/30) second×(1/530 mm).

Although an optimum value of a relationship between the above-mentioned display time and the display stop time is changed with various condition such as a running speed of a train, an intensity of light emitted from the LED display device 6 and the size of the LED display device 6, a study of experimental results revealed that, if the optimum value falls within the above-mentioned range, then a still picture is hardly blurred and a still picture could be watched as a more sharp still picture.

Figure 5:
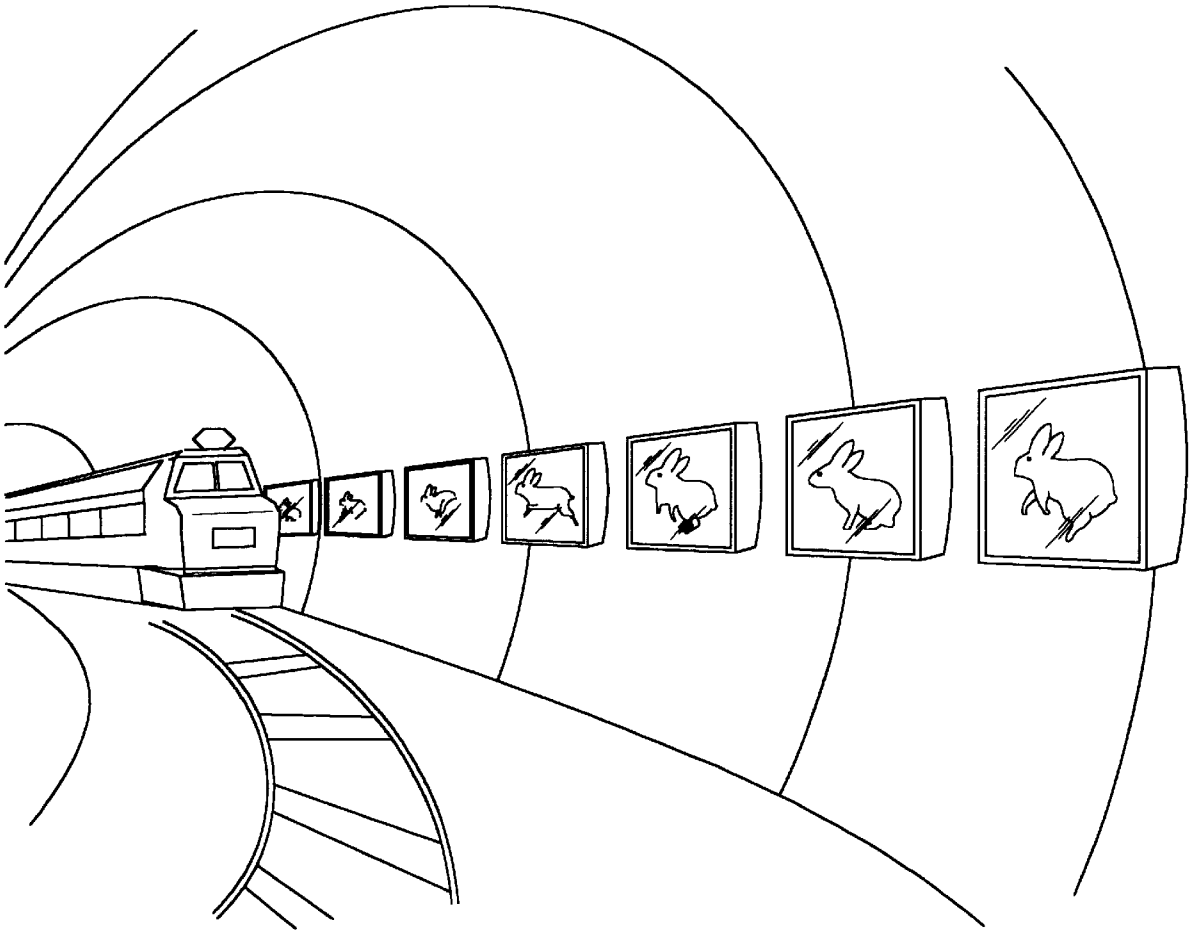
FIG. 5 is a pictorial representation showing a relationship between a train running through a tunnel and LED display devices.

FIG. 5 is a pictorial representation schematically showing a relationship between the train 4 and a plurality of LED display devices 6 installed within the tunnel 5 when the display time is selected as set forth above. Although FIG. 5 illustrates that still pictures are being displayed before or after the train 4 passes the tunnel 5, this is not the actual state and is illustrated in order to understand the present invention more clearly. In actual practice, the still picture is being displayed during a period of time until the train 4 passes the first LED display device 6 after the top of the train 4 has passed the first LED display device 6.

While the output of the buffer memory 10 is controlled so as to enable the LED display device 6 to display still pictures intermittently, the present invention is not limited thereto, and a similar intermittent display may be made possible by intermittently supplying an electric power (power supply) to the LED display device 6 so as to satisfy the relationship shown in FIG. 4.

In order for the viewer to visually confirm the successive still pictures as a real moving picture, a movie needs 24 frames per second, the NTSC standard television system needs 30 frame per second, and the PAL standard television system needs 25 frames per second. Accordingly, in order to obtain an ordinary real moving picture, there are required 24 frames/second at the lowest. In this embodiment, the present invention will be described with reference to the case of 30 frames/second.

The interval in which the LED display devices 6 are installed and the size of the LED display device 6 required when the LED display devices 6 are installed on the tunnel wall 5*a* which the train 4 passes will be described below. The interval is changed with the running speed of the train 4, and the size of the LED display device 6 is changed with the distance in which the train 4 and the tunnel wall 5*a* are opposed to each other. The following table 1 shows speed/hour and speed/second of the train 4 and the spacing in which the LED display devices 6 are installed.

TABLE 1

| SPEED PER HOUR (km) | SPEED PER SECOND (m) | INTERVAL (cm) |
|---|---|---|
| 40 | 11.1 | 37 |
| 60 | 16.6 | 53 |
| 80 | 22.2 | 74 |
| 100 | 27.7 | 92 |
| 120 | 33.3 | 111 |
| 150 | 41.6 | 139 |
| 200 | 55.5 | 185 |

A study of table 1 reveals that the speed/second of the moving vehicle (train 4) whose speed/hour is 60 km is 16.6 m. Since the still picture of 30 frames have to exist within 16.6 m, the interval between the LED display devices 6 is given as 16.6 m/30=53 cm. Accordingly, it is to be understood that the lateral size of the LED display device 6 used is limited by the above-mentioned interval.

If the train passing speed in the place where the LED display devices 6 are installed is determined, then the interval in which the LED display devices 6 are installed and the size of the LED display device 6 are determined necessarily. In the above-mentioned embodiment, since the speed/hour is 60 km and the interval is 53 cm, it is to be considered that the size, i.e. width of the LED display device 6 is less than approximately 50 cm (accordingly, the height thereof should preferably be less than 50 cm). However, since the spacing from the window 4*a* of the train 4 to the LED display device 6 is generally about 50 cm, taking this into consideration, the suitable LED display device 6 might have a width approximately ranging from 25 to 40 cm.

Although it may be understood from the above-mentioned table 1 that the size of the LED display device 6 can be increased in response to the increase of the speed of the train 4, if the distance from the window 4*a* of the train 4 to the LED display device 6 is approximately 50 cm, there is then the risk that the whole of the still picture will not be visually confirmed by an LED display device which is too large in size. When the above-mentioned distance is 1 m or 2 m and the speed of the train 4 is high, the width of the LED display device 6 may be increased in response to the increased distance and the increased speed as described above.

While the still picture signals which sequentially represent successive motions comprising one moving picture (contents of matched moving picture) are stored in the video memory 7 as described above, in actual use, it is frequently observed that the contents of a plurality of moving pictures with different contents are stored in the video memory 7.

When the moving picture is such one used to advertise goods or used in advertisement, for example, the contents of moving pictures are different depending upon sponsors. When the contents of moving pictures are different as described above, any of these moving picture contents (hereinafter referred to as programs) are temporarily stored in the video memory 7.

Then, one of a plurality of these programs is supplied from the video memory 7 to the buffer memory 10 under control of the video memory control device 8, and the LED display device 6 is intermittently driven to display successive moving pictures.

FIG. 6 schematically illustrates a plurality of programs stored in this video memory 7. When a plurality of programs are stored in the video memory 7, as shown in FIG. 6, a still picture video signal used to advertise cosmetics is accumulated in a program address 01, for example. Similarly, a still picture video signal used to advertise automobiles, for example, is accumulated in a program address 02. In this connection, in the example shown in FIG. 6, a still picture video signal used to advertise hamburgers is accumulated in a program address 03, a still picture video signal used to advertise coffee is accumulated in a program address 06, a still picture video signal used to advertise whisky, beer is accumulated in a program address 07, a still picture video signal used to advertise tobacco is accumulated in a program address 08, and a still picture video signal used to advertise electric manufactured products is accumulated in a program address 09.

Although the manner in which a still picture video signal is accumulated in a program address is arbitrary, a still picture video signal will be accumulated in a program address by using the image input device 14 as follows. Initially, a still picture video signal of a predetermined number of frames concerning cosmetics is entered from the image input device 14, and stored in the program address 01 of the video memory 7. Then, a still picture video signal of a predetermined number of frames concerning automobiles is entered from the image input device 14 and stored in the program address 02 of the video memory 7. Remaining still picture video signals of a predetermined number of frames will hereinafter be stored in address programs of the video memory 7 sequentially by the similar procedure.

The lists in which a plurality of programs are stored as shown in FIG. 6 are referred to as "program lists". The program lists may be visually confirmed by the monitor 13 or 15 if necessary.

Figure 7:
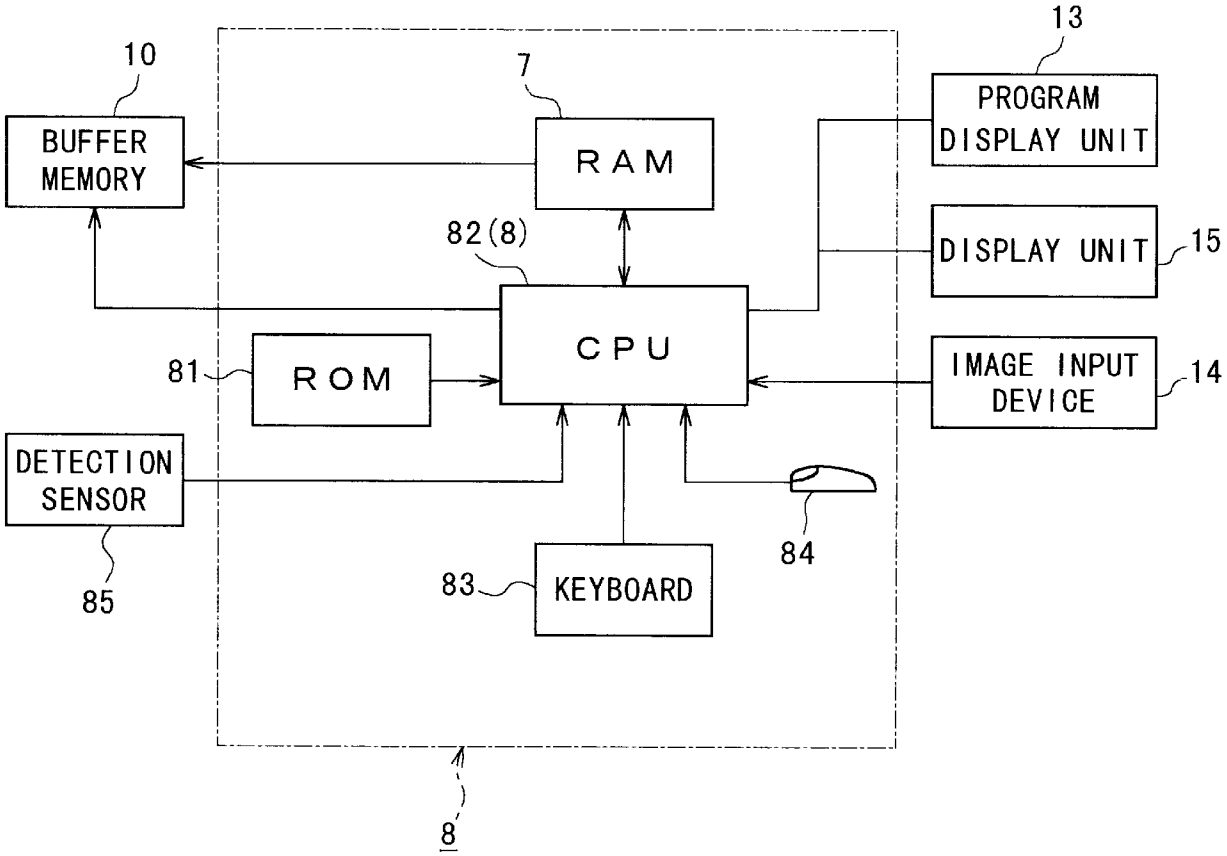
FIG. 7 is a block diagram used to explain main sections concerning a control operation according to the present invention.

The video memory control device 8 may generally be formed of a personal computer. FIG. 7 shows in block form the video memory control device 8 formed of the personal computer concretely. As shown in FIG. 7, the video memory control device 8 comprises a ROM (read-only memory) 81 in which control programs are stored, a CPU (central-processing unit) 82, a keyboard 83 for entering control information and an external input device, in this example, mouse 84.

A detection device 85 is adapted to detect whether or not the train 4 approaches the place in which the LED display device 6 is installed. A detection signal from the detection device 85 is inputted to the CPU 82. In this example, the detection device 85 might be a detection sensor for detecting whether or not the tip end portion (motorman seat) of the train 4 passes the LED display device 6. This detection sensor 85 is installed at the side of the LED display device 6 closest to the tip end portion of the train. The detection signal which has detected that the train 4 passed the LED display device 6 is supplied to the CPU 82.

When the CPU 82 receives this detection signal, the CPU 82 controls the buffer memory 10 in such a fashion that the still video signal, which was stored in the buffer memory 10 through the signal line 12 as described above, is supplied to the LED display device 6.

When the time period in which the detection sensor 85 is energized elapses, i.e. the train 4 passes the LED display device 6, the CPU 82 sends a display end signal to the buffer memory 10 through the signal line 12, whereby the LED display device 6 ends the successive moving display concerning the still picture video signal of the cosmetics stored in the program list 01.

When the transmission of the still picture video signal concerning the program list 01 is ended, this time, the CPU 82 changes the program list 01 to the program list 02. Thus, the program list 02 stored in the video memory 7, in this example, the still picture video signal concerning the automobiles is sent to the buffer memory 10, and the contents of the buffer memory 10 are changed from the video information of the cosmetics to the video information of the automobiles.

Then, when the detection sensor 85 detects that the next train 4 passes the LED display device 6, the successive moving picture display apparatus effects the same operation as mentioned above, and is placed in the successive display mode of other picture. When the display operation is ended, the contents of the buffer memory 10 are rewritten from the program list 02 to the program list 03.

Figure 8:
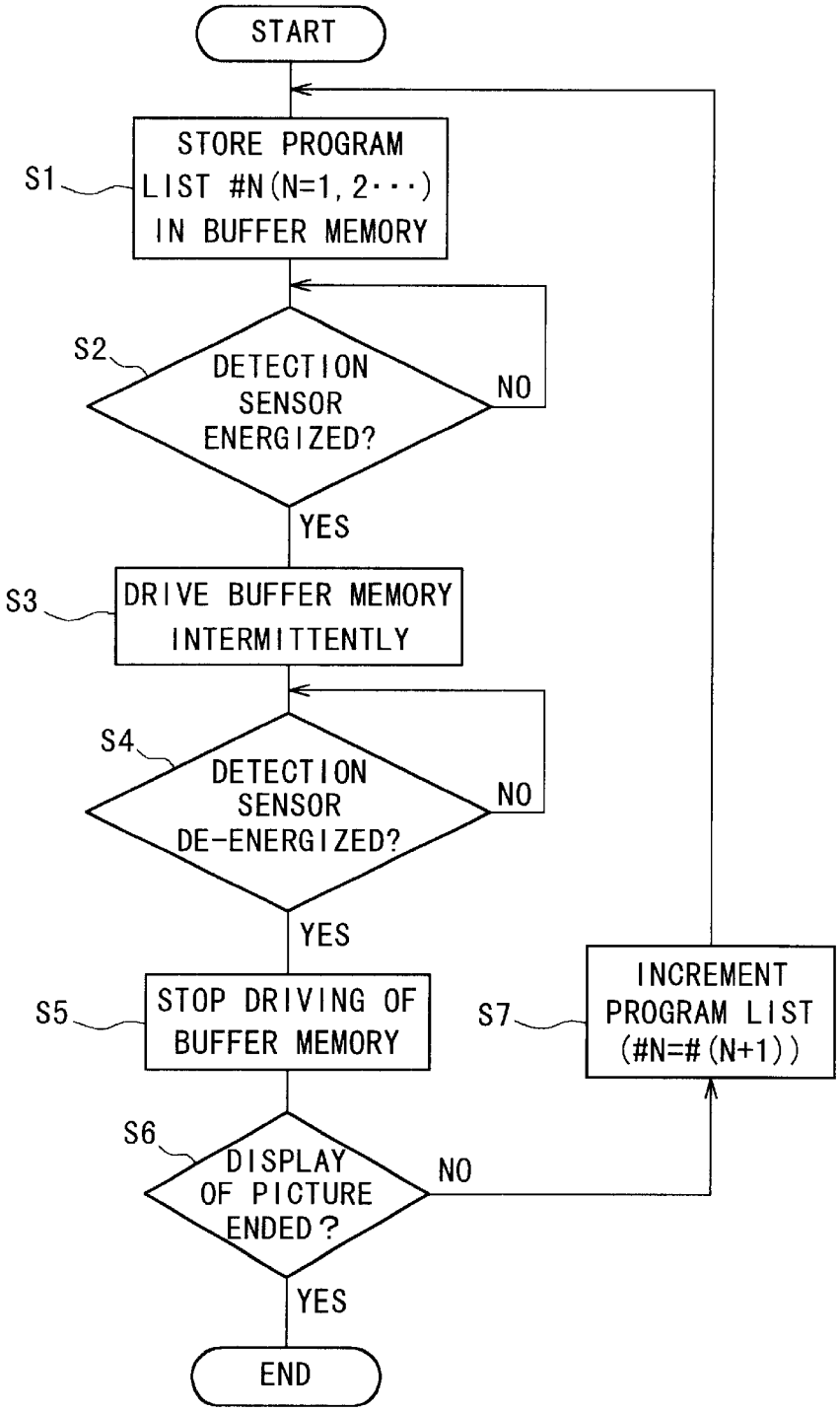
FIG. 8 is a flowchart to which reference will be made in explaining the manner in which a picture is displayed according to the embodiment of the present invention.

FIG. 8 is a flowchart showing the above-mentioned operation.

Referring to FIG. 8, and following the start of operation, at a step S1, the contents of the program list 01 are stored in the buffer memory 10 as the initial mode. At the next decision step S2, it is determined whether or not the detection sensor 85 detects the arrival of the train 4. If the detection sensor 85 is energized, i.e. the detection sensor 85 detects the arrival of the train 4 as represented by a YES at the decision step S2, then control goes to a step S3. At the step S3, the buffer memory 10 is intermittently driven under control of the CPU 82. If the detection sensor 85 is not energized, i.e. the detection sensor 85 does not yet detect the arrival of the train 4 as represented by a NO at the decision step S2, then control goes back to the step S2, and the step S2 is repeated until the detection sensor 85 is energized. At the next decision step S4, it is determined whether or not the detection sensor 85 is de-energized. If the detection sensor 85 is de-energized as represented by a YES at the decision step S4, then control goes to a step S5, whereat the operation of the buffer memory 10 is stopped under control of the CPU 82.

At the next decision step S6, it is determined whether or not the video display mode is continued. If the video display mode is continued as represented by a NO at the decision step S6, then control goes to a step S7, whereat the program list 01 is incremented by "1". Then, control goes back to the step S1, whereat the successive moving picture display apparatus is placed in the similar video display operation standby state.

If the video display mode is ended as represented by a YES at the decision step S6, then this video display processing program is ended. Since the program list is updated each time the train 4 passes the LED display device 6 during the video display mode, it is possible to automatically rewrite the displayed program each time the train 4 passes the LED display device 6. Therefore, depending upon the manner in which a program to be transmitted is programmed, the number in which each program provided for passengers is transmitted can be made the same.

While the program list is rewritten each time the train 4 passes the LED display device 6 as described above, the present invention is not limited thereto, and the program list may be rewritten not each time the train 4 passes the LED display device 6 but each time the train 4 passes the LED display device 6 five times. Alternatively, a frequency at which a program list is rewritten may be changed at every program.

If it is intended to successively display the still pictures three times with respect to the cosmetics on the program list 01, for example, then the still picture video signal concerning the cosmetics is transmitted to the buffer memory 10, and "3" is designated as frequency data indicative of the frequency at which the program list is displayed. When this frequency data goes to "0", the program may be rewritten. Concurrently therewith, frequency data of the next program also may be designated.

Figure 9:
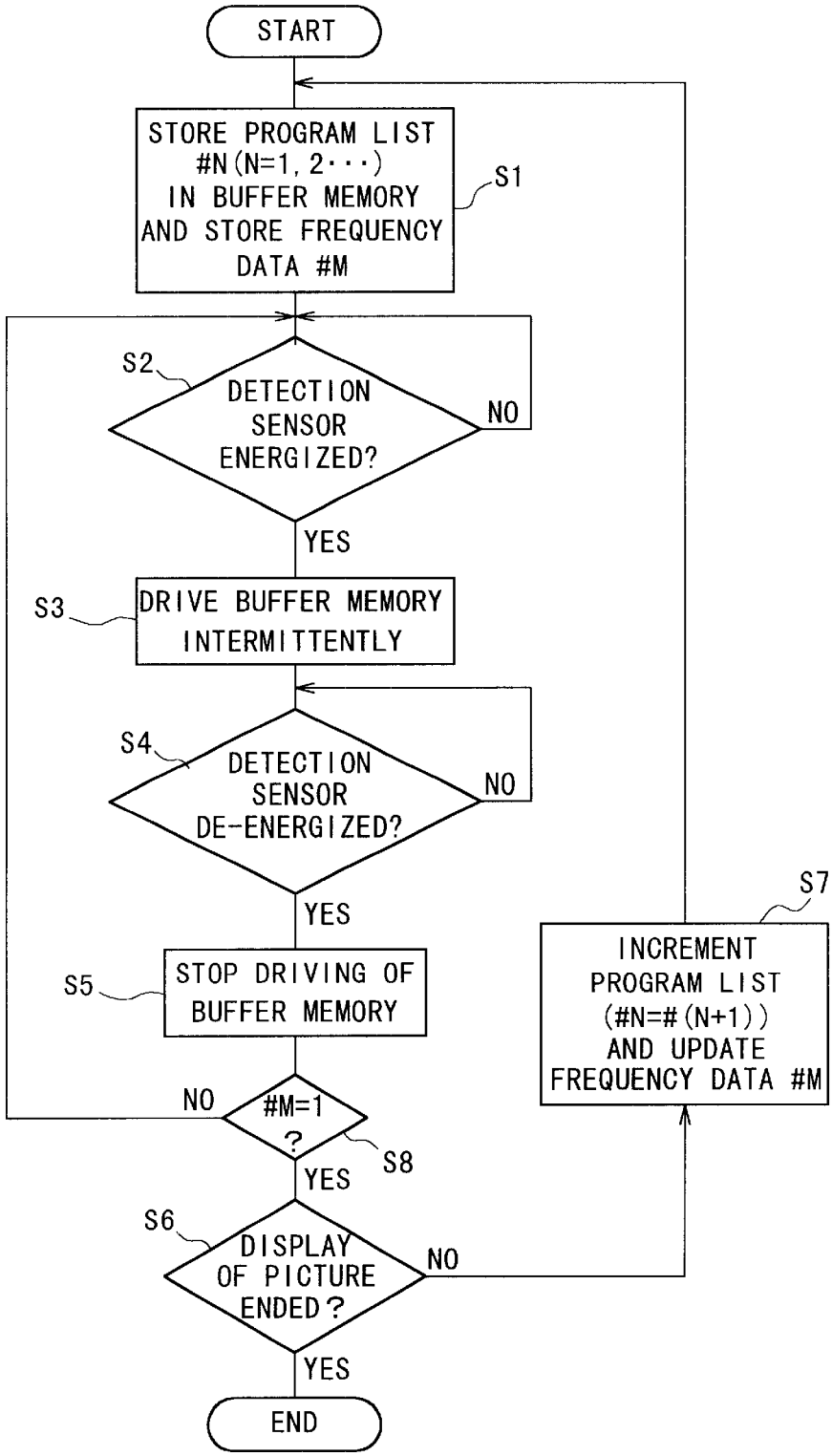
FIG. 9 is a flowchart to which reference will be made in explaining another manner in which a picture is displayed according to the embodiment of the present invention.

In order to effect the above-mentioned processing, the following steps shown in a flowchart of FIG. 9 should be executed. Referring to FIG. 9, and following the start of operation, initially, at a step S1, in addition to the transmitted program #N (N=1, 2 . . . ), frequency data #M is inputted. Then, at a decision step S8, the number at which the train 4 passes the LED display device 6 is counted, and the same program is repeated until #M=1. If #M=1 is satisfied as represented by a YES at the decision step S8, then control goes to the next decision step S6, whereat it is determined whether or not the video display mode is ended. If the video display mode is not ended as represented by a NO at the decision step S6, then control goes to the step S7, whereat the program list #N is incremented so long as a display stop command is not issued, and frequency data #M in a new program is updated. Then, control goes back to the step S1. Other steps in the flowchart of FIG. 9 are the same as those of the flowchart of FIG. 8, and therefore need not be described.

Therefore, the display frequency may be set at every program. For example, the still picture video signal concerning the cosmetics on the program list 01 may be displayed successively up to three times, and the still picture video signal concerning the automobile on the program list 02 may be displayed successively up to five times.

Alternatively, it is possible to change the display frequency in the time period of a day. In the case of a program list that displays pictures of alcoholic drinks such as beer and whisky, for example, the frequency at which such program list for displaying alcoholic drinks is displayed is increased in the time period after 5.00 P.M. in order to target when office workers go home. Also, in the case of a program list for displaying pictures of foodstuffs such as hamburgers, the program list may be programmed in order to change the display frequency in response to the display time period so that the frequency at which the pictures of hamburgers are displayed may be increased so as to target a time period of mealtime.

In order to change the frequency at which the display program list should be displayed under a variety of conditions, it is necessary to change or rewrite data concerning the frequency at which the display program list should be displayed and the time period of the display program list.

FIG. 10 illustrates an example of program lists obtained when the display time period and the frequency at which the program list should be displayed are taken into consideration, respectively. According to this example, as shown in FIG. 10, concerning the cosmetics on the program list 01 and the automobile on the program list 02, corresponding pictures are constantly displayed at predetermined frequencies regardless of time period; concerning the hamburgers on the program list 03, corresponding pictures are displayed at a high frequency in a time period ranging from 11:00 to 13:00 hours and concerning whisky and beer on the program list 07, corresponding pictures are intensively displayed at a high frequency in a time period ranging from 17:00 to 20:00 hours.

When a time period and a display frequency are determined, the picture illustrated in FIG. 10 may be displayed on the monitor (display unit) 15 and a user may enter data indicative of the time period and the display frequency by effectively utilizing the keyboard 83 and the mouse 84 (FIG. 7).

While the time period and the display frequency are displayed on the monitor 15 during a period until the train 4 passes the LED display device 6 since the train 4 has arrived, the present invention is not limited to the above-mentioned video display mode, and the time period and the display frequency may be displayed on the monitor 15 during a predetermined time (e.g. 3 seconds or 5 seconds) after the train 4 arrived. In short, the video display mode may be set freely depending upon the program list to be transmitted.

While the program lists are created by the image input device 14 and directly stored in the video memory 7 as described above, the present invention is not limited thereto, and previously-created program lists may be used. For example, as the previously-created program lists, there may be used a card which might be recently referred to as "electronic card" incorporating a memory. In this case, there may be used an electronic card in which the program lists shown in FIG. 10 are stored together with corresponding still picture video signals of a plurality of frames. The video memory 7 may be replaced with the electronic card when this electronic card is inserted into the slot of the video memory control device 8.

While the smooth real moving pictures have been displayed so far by the above-mentioned video display operation, the present invention is not limited thereto, and it is frequently observed that more effective visual expression effects may be achieved by awkward motions intentionally. That is, the moving pictures may be displayed by a so-called limited animation. In that case, still pictures of 30 frames/second which are slightly different from each other might not be displayed but the still picture video signals of less frames, e.g. 15 frames might be displayed at 30 frames/second.

To realize this limited animation, the video memory 7 is controlled in such a manner that the still picture video signal stored in the video memory 7 in which successive still pictures are stored may be simultaneously used by a plurality of LED display devices 6.

For example, the first still picture video signal in the video memory 7 is sent to the consecutive addresses (e.g. A and B) of the buffer memory 10 (FIG. 2), whereby the same still picture video signal is supplied to the two adjacent LED display devices 6 from the buffer memory 10. The second still picture video signal (video signal of the second frame) stored in the video memory 7 is not used, and the third still picture video signal is sent to the consecutive addresses (e.g. C and D) of the buffer memory 10.

With the above-mentioned arrangement, since the picture is displayed by video information whose data amount is half of that of video information used to display a real moving picture, such a real moving picture is visually confirmed as an extremely awkward moving picture, thereby resulting in the limited animation effect being achieved.

The above-mentioned operation is realized by decimating the number of frames to 1/2. Alternatively, the number of frames may be decimated to 1/3 or 1/4, and a picture may be displayed by simultaneously supplying the video signal of the same frame to the three or four LED display devices 6. If the CPU 82 is used as the control means as described above, a variety of visual expressions may become possible by controlling the address of the video memory 7.

While the LED display device was described so far as the display device 6 in the above-mentioned explanation, the present invention is not limited thereto, and the LED display device may be replaced with a liquid-crystal display (LCD) device. While two systems of reflection-type and transmission-type liquid-crystal display devices are now available, any of the reflection-type and transmission-type liquid-crystal display devices may use a strobe light as a flashing light source. The transmission-type liquid-crystal display device uses a strobe light as a back-light (intermittent illumination device), and the reflection-type liquid-crystal display device uses a strobe light as a mere illumination device.

Figure 11:
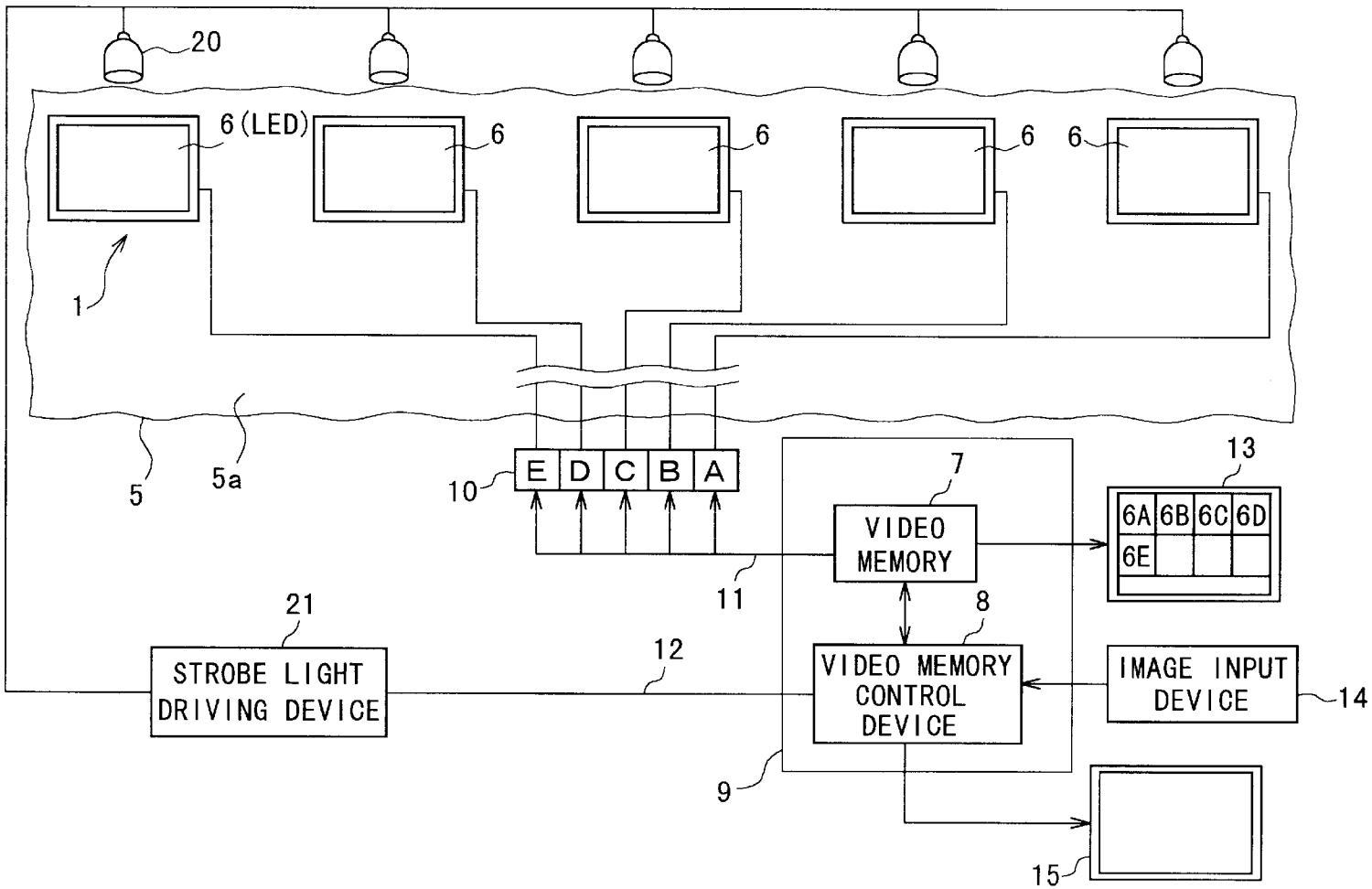
FIG. 11 is a block diagram showing a video display apparatus using liquid-crystal display (LCD) devices according to another embodiment of the present invention.

FIG. 11 shows in block form a video display apparatus using the liquid-crystal display device according to another embodiment of the present invention. In FIG. 11, elements and parts identical to those of FIG. 2 are marked with the same reference numerals, and therefore need not be described. In this embodiment, as shown in FIG. 11, there are provided a plurality of strobe lights 20 and a strobe light driving circuit 21 which drives these strobe lights 20. A video flashing control signal outputted from the video memory control device 8 through the signal line 12 is supplied to the strobe light driving circuit 21, thereby controlling the flashing of the strobe lights 20.

Even when the strobe light 20 is used, since the duty ratio of its flashing is the same as that of the LED display device, the strobe light driving circuit 21 is operated in response to a flashing control signal expressed by the duty ratio shown in FIG. 4.

While one strobe light 20 is disposed in response to each of the liquid-crystal display devices 6 as shown in FIG. 11, if the liquid-crystal display device 6 has a width approximately ranging from 30 to 50 cm, then one strobe light 20 may be used commonly by more than two liquid-crystal display devices, e.g. two liquid-crystal display devices.

Figure 12:
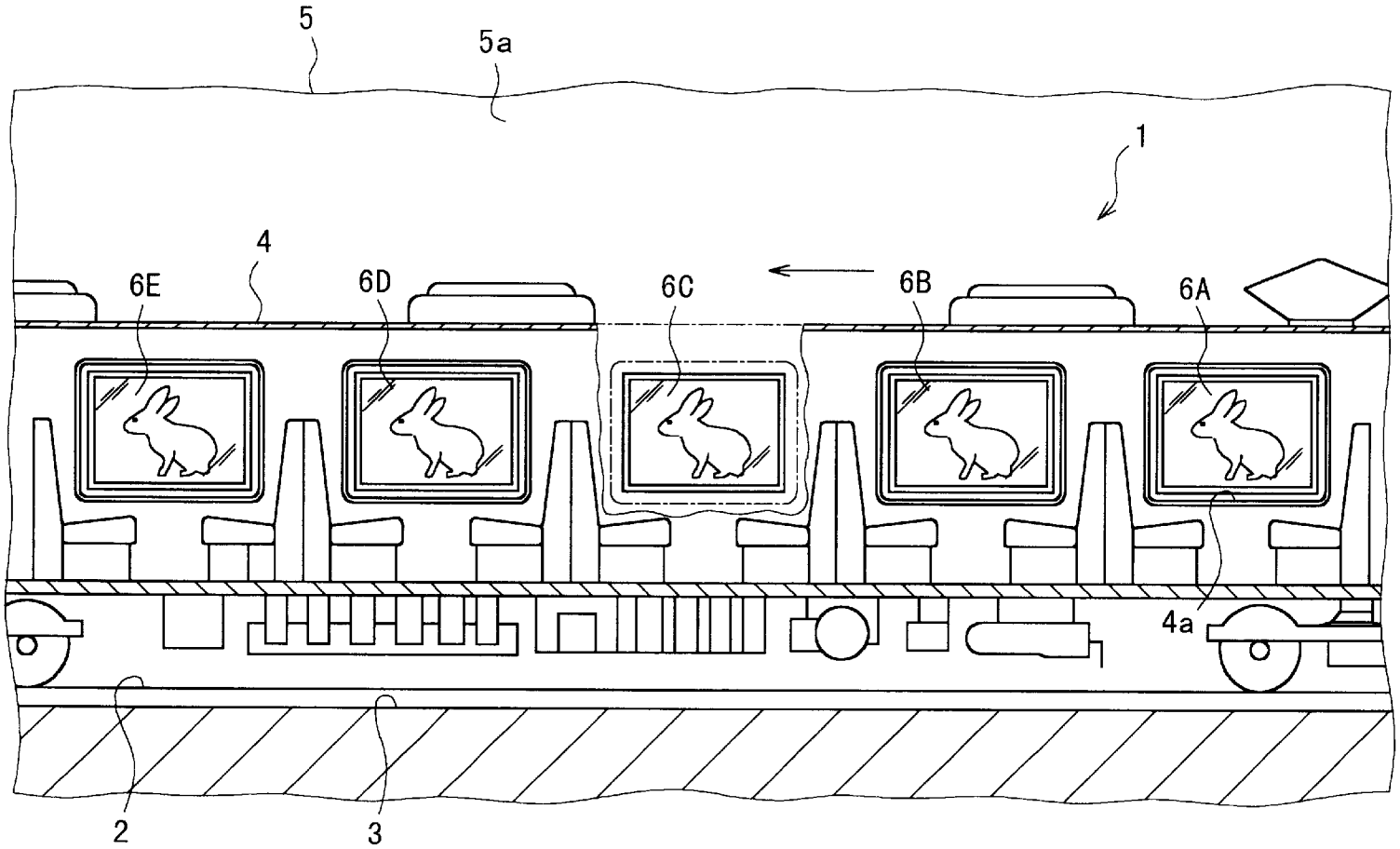
FIG. 12 is a conceptual diagram showing a relationship between passengers and stationary video display apparatus opposing the passengers according to another embodiment of the present invention.

Modified examples of the above-mentioned embodiments will be described below. Firstly, the above-mentioned case is the modified example in which the still picture video signal which represents the successive motions visually confirmed by the passengers on the train 4 is supplied to the respective display devices 6. On the other hand, a still picture video signal which represents a picture that may be visually confirmed as a complete still picture by the passengers on the train 4 may be supplied to the respective display devices 6. In this case, exactly the same video signal is stored in the video memory 7. If the video signal is simultaneously supplied to the display device 6 under the same conditions shown in FIG. 4, then the complete still pictures may be displayed on the outside of the windows 4*a* of the train 4 as shown in FIG. 12.

The advantages brought about by the supply of such still pictures will be described below. If information (only character information or combination of character information and pictures) given to the passengers from an enterprising man of a moving vehicle, for example, or similar information provided by a variety of public institutions is a still picture to any passengers, then it becomes easy for the passengers to understand the contents of such information more clearly. This picture may be very slightly moved in the direction opposite to the traveling direction of the train 4.

Figure 13:
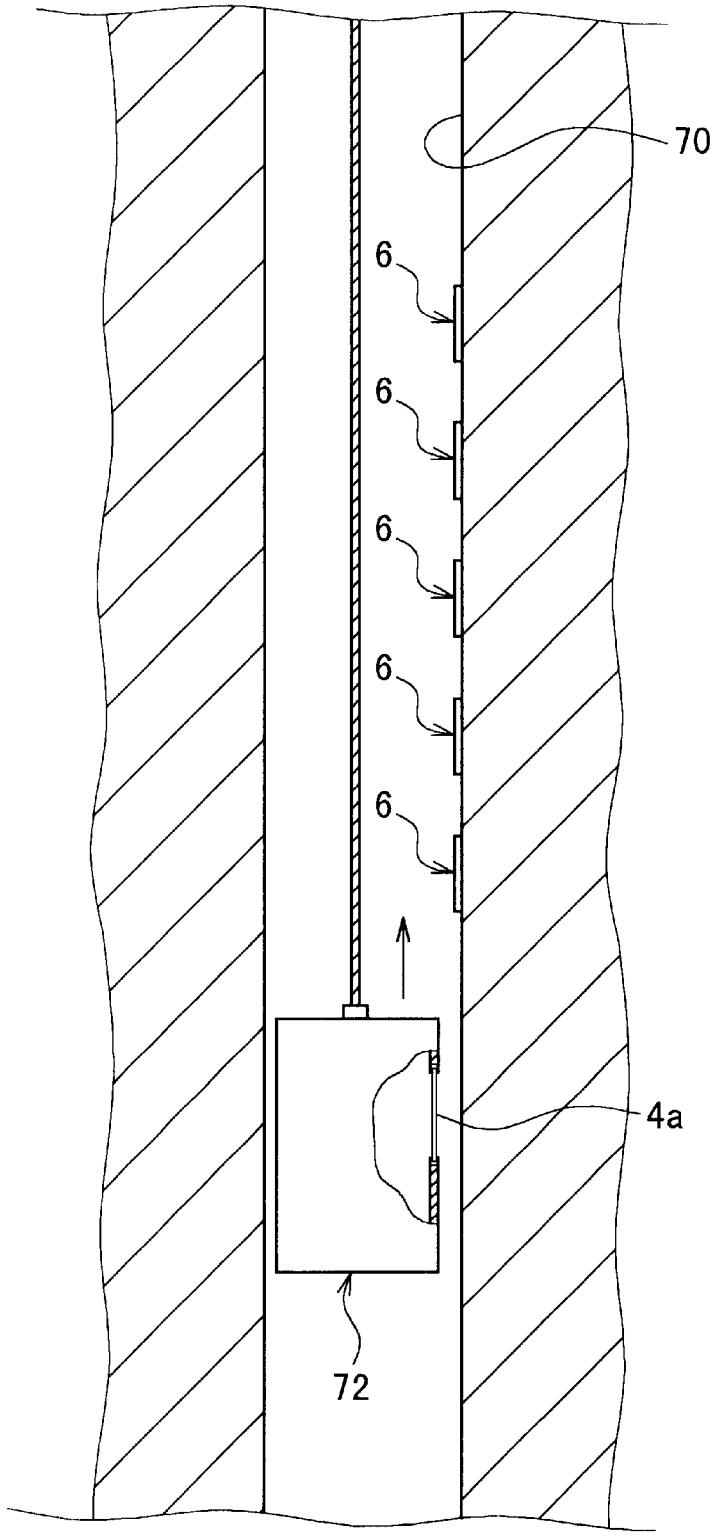
FIG. 13 is a conceptual diagram (front view) showing a relationship between a moving vehicle and a video display apparatus obtained when the moving vehicle is an elevator.
Figure 14:
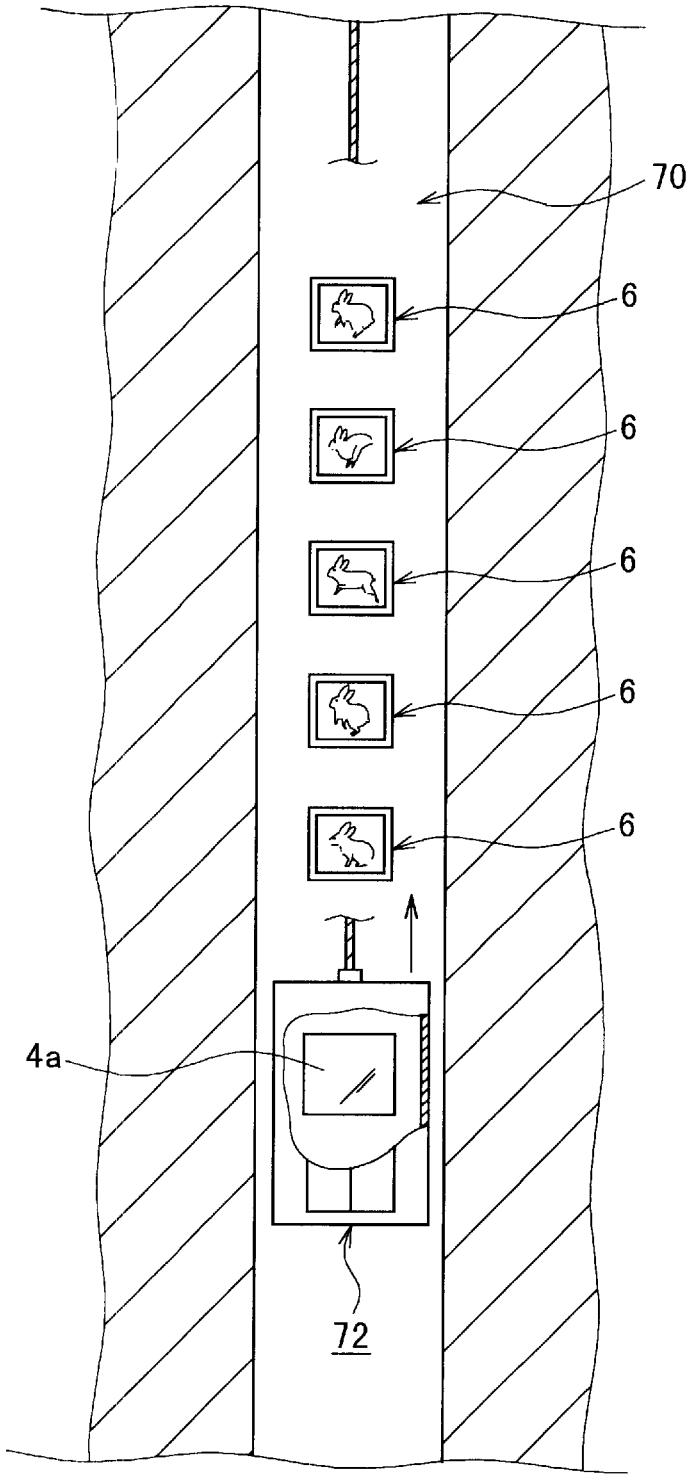
FIG. 14 is a side view of FIG. 13 and illustrates a relationship between a moving vehicle and a video display apparatus obtained when the moving vehicle is the elevator.

Secondly, while the train 4 was so far described as the moving vehicle, the present invention is not limited thereto, and the moving vehicle might be an elevator, an escalator, a moving sidewalk, a conveyance in an amusement park or a road. FIG. 14 shows the case in which the present invention is applied to an elevator 72. A plurality of display devices 6 are vertically arrayed at a constant interval within a hollow side wall 70 (see FIGS. 13 and 14). By supplying the video display contents in the opposite direction as the elevator 72 is elevated or lowered, it becomes possible for the passengers on the elevator 72 to visually confirm successive moving pictures or still pictures regardless of the fact that the elevator 72 is the up elevator or the down elevator.

Figure 15:
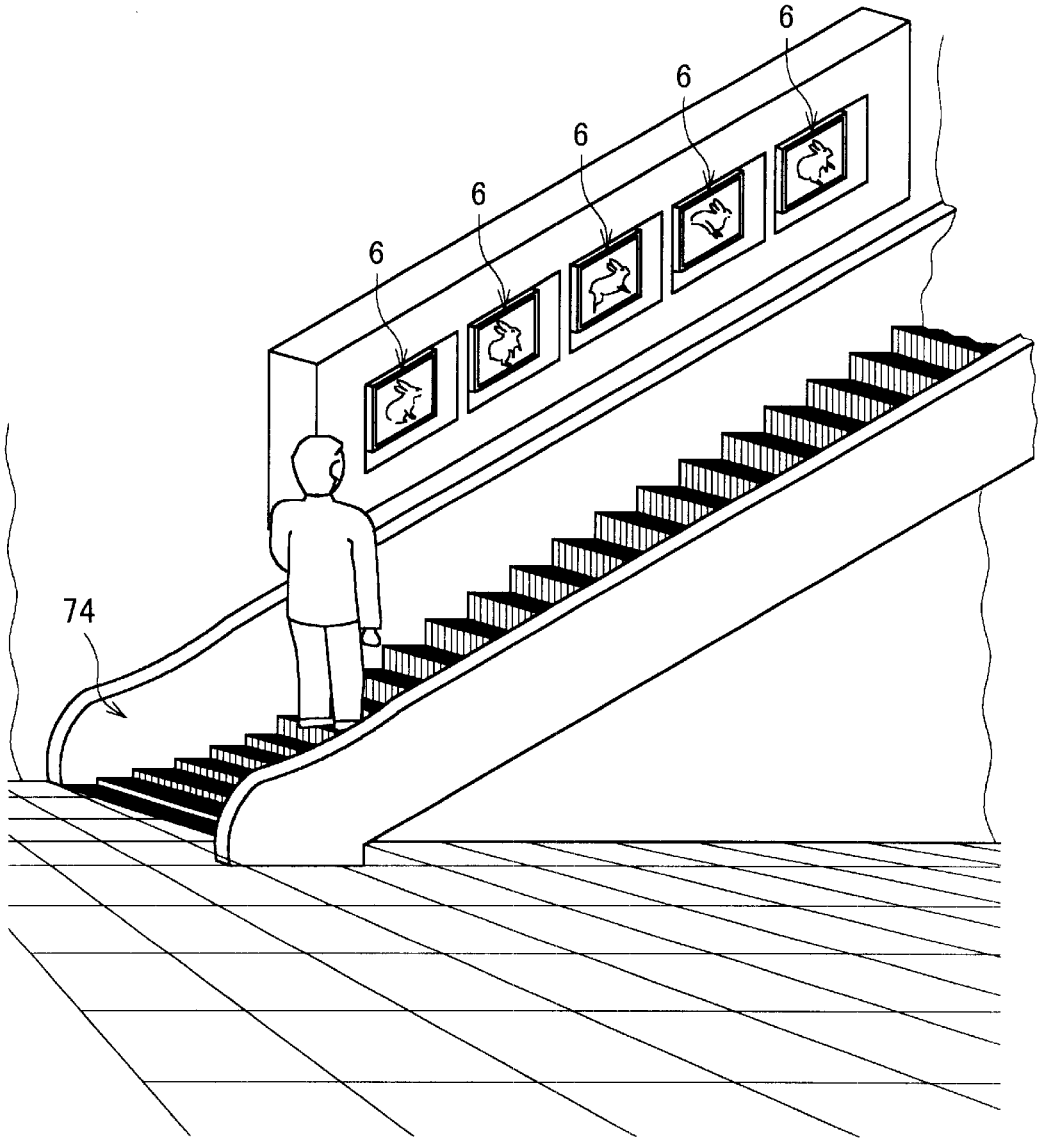
FIG. 15 is a conceptual diagram showing a relationship between a moving vehicle and a video display apparatus obtained when the moving vehicle is an escalator.

FIG. 15 shows the case in which a passenger on an escalator 74 becomes able to enjoy successive moving pictures or still pictures. As shown in FIG. 15, a plurality of display devices 6 are disposed on the wall along the escalator 74. A timing at which pictures are flashed may be adjusted in accordance with the running speed of the escalator 74.

Thirdly, the video source for displaying pictures might be a video source for displaying mainly character information such as the notice of a moving vehicle enterprise from the subway and the notice of the public institution, in addition to the commercial pictures for advertisement and propaganda.

Fourthly, while the buffer memory 10 is provided on the side of the video signal supplying device 9 in the example shown in FIG. 2, the present invention is not limited thereto, and each display device 6 may incorporate the buffer memory 10.

In this case, it is sufficient that a single signal line such as a coaxial cable or an optical cable may be laid from the video memory 7. Necessary information is transmitted to and saved in each of the display devices 6 by packet communication. Control signals (a display timing signal, a power supply control signal, etc.) also may be transmitted to each display device 6 from the side of the video signal supplying device 9 by using the same cable.

Fifthly, while it is premised that the speed of the moving vehicle is constant, the present invention may also be applied to other cases. In that case, if the running speed of the moving vehicle is detected and the display timing of each display device 6 is controlled on the basis of that detection signal, then it is possible for the viewer to watch successive moving pictures or still pictures.

Sixthly, when the video display apparatus according to the present invention is applied to the inside of the tunnel, such video display apparatus may be installed freely at any position within the tunnel. For example, the video display apparatus according to the present invention may be freely installed at the entrance of the tunnel or at the center of the tunnel. Moreover, the video display apparatus according to the present invention ma be freely installed at a plurality of places within the same tunnel. In this case, the video display apparatus according to the present invention are able to display pictures in unison with each other or are able to display pictures independently. Furthermore, a network concerning the picture display may be constructed among stations. According to such network thus constructed, the video display apparatus may cope with an emergency and the like.

While the invention has been described with reference to specific embodiments chosen for purpose of illustration, it should be apparent that numerous modifications could be made thereto by those skilled in the art without departing from the basic concept and scope of the invention.

What is claimed is:

1. A video display apparatus comprising:

a plurality of display devices positioned at predetermined intervals for viewing by passengers on a moving vehicle;

a video signal supplying device for supplying a still picture video signal to said plurality of display devices; and intermittent display control means for energizing said plurality of display devices simultaneously and making a display time where said still picture video signal is displayed on said plurality of display devices become shorter than a non-display time where said still picture video signal is not displayed, wherein $100t1<t2$ where t1 is the video display time and t2 is the non-display time in which a still picture is not displayed, and wherein said still picture video signal is a video signal representing step-by-step pictures each of which are different and are supplied to respective display devices and represent successive motions of a picture as seen from said moving vehicle.

2. The video display apparatus as claimed in claim 1, wherein said display device is a two-dimensional display device having light-emitting diodes arrayed in a matrix fashion.

3. The video display apparatus as claimed in claim 1, wherein said display device is a transmission-type liquid-crystal display device and said intermittent display control means is a back-light.

4. The video display apparatus as claimed in claim 1, wherein said display device is a reflection-type liquid-crystal display device and said intermittent display control means is a strobe light.

5. The video display apparatus as claimed in claim 3, wherein said back-light is a strobe light.

6. A video display method comprising the steps of:

generating a plurality of still pictures which are sequentially displayed to represent successive motions;

storing said plurality of still pictures generated at the generating step in a memory device; and intermittently displaying said plurality of stored still pictures in respective corresponding display devices, wherein said intermittent display step is characterized in that $100t1<t2$ where t1 is a video display time and t2 is a non-display time where said stored still pictures are not displayed.

7. The video display method as claimed in claim 6, wherein said still picture video signal is a video signal representing step-by-step pictures each of which are different and are supplied to respective display devices and represent successive motions of a picture as seen from said moving vehicle.

8. The video display method as claimed in claim 6, wherein said still picture video signal is the same video signal relative to respective display devices and represents a still picture of a picture as seen from said moving vehicle.

9. A video display apparatus comprising:

a plurality of liquid-crystal display devices positioned at predetermined intervals for viewing by passengers on a moving vehicle;

a video signal supplying device for supplying a still picture video signal to said plurality of liquid-crystal display devices;

a light source for energizing said plurality of liquid-crystal display devices; and light-source flashing control means for controlling the flashing of said light source, wherein said video signal supplying device includes a random-access memory (RAM) for storing said still picture video signal, wherein a still picture video display time t1 is shorter than a non-display time t2 in which a still picture video signal is not displayed, such that $100t1<t2$, and wherein said still picture video signal is a video signal representing step-by-step pictures each of which are different and are supplied to respective display devices and represent successive motions of a picture as seen from said moving vehicle.

10. The video display apparatus as claimed in claim 9, wherein said random-access memory stores a plurality of programs relative to a video signal for displaying a picture.

11. A video display apparatus comprising:

a plurality of display devices positioned at predetermined intervals for viewing by passengers on a moving vehicle;

still picture video signal memory means for supplying a still picture video signal to said plurality of display devices;

control means for controlling said still picture video signal memory means;

detection means for detecting whether said moving vehicle is located at a position in which said plurality of display devices are installed; and an illumination device for intermittently displaying said plurality of display devices, wherein said still picture video signal memory means stores a still picture video signal comprising a plurality of programs whose contents are different from each other, said programs are selected under control of said control means, and a still picture video signal corresponding to a selected program is supplied to said display device and controlled by said control means, such that a still picture video display time t1 is shorter than a non-display time t2 in which a still picture video signal is not displayed, wherein $100t1<t2$, and wherein said still picture video signal is a video signal representing step-by-step pictures each of which are different and are supplied to respective display devices and represent successive motions of a picture as seen from said moving vehicle.

12. The video display apparatus as claimed in claim 11, wherein said display device is a two-dimensional display device having light-emitting diodes arranged in a matrix fashion.

13. The video display apparatus as claimed in claim 11, wherein said display device is a transmission-type liquid-crystal display device, and said intermittent illumination device is a back-light.

14. The video display apparatus as claimed in claim 11, wherein said display device is a reflection-type liquid-crystal display device, and said intermittent illumination device is a strobe light.

15. A video display apparatus comprising:

a plurality of display devices positioned at predetermined intervals for viewing by passengers on a moving vehicle;

still picture video signal memory means for supplying a still picture video signal to said plurality of display devices;

control means for controlling said still picture video signal memory means;

detection means for detecting whether or not said moving vehicle is located at a position in which said plurality of display devices are installed; and an illumination device for intermittently displaying said plurality of display devices, wherein said still picture video signal memory means stores a still picture video signal comprising a plurality of programs whose contents are different from each other, said programs are selected under control of said control means, and a still picture video signal supplied to said plurality of display devices is changed at least at a unit of said programs under control of said control means, such that a still picture video signal display time t1 is shorter than a non-display time t2 in which a still picture video signal is not displayed, wherein 100t1<t2, and wherein said still picture video signal is a video signal representing step-by-step pictures each of which are different and are supplied to respective display devices and represent successive motions of a picture as seen from said moving vehicle.

16. The video display apparatus as claimed in claim 15, wherein said still picture video signal is changed at said unit of said programs each time a detection signal from said detection means is inputted to said control means.

17. The video display apparatus as claimed in claim 15, wherein said display device is a two-dimensional display device having light-emitting diodes arranged in a matrix fashion.

18. The video display apparatus as claimed in claim 15, wherein said display device is a transmission-type liquid-crystal display device, and said intermittent illumination device is a back-light.

19. The video display apparatus as claimed in claim 15, wherein said display device is a reflection-type liquid-crystal display device, and said intermittent illumination device is a strobe light.

20. A video display apparatus comprising:

a plurality of display devices positioned at predetermined intervals for viewing by passengers on a moving vehicle;

still picture video signal memory means for supplying a still picture video signal to said plurality of display devices;

control means for controlling said still picture video signal memory means; and an illumination device for intermittently displaying said plurality of display devices, wherein said still picture video signal memory means stores a still picture video signal comprising a plurality of programs whose contents are different from each other, and the number in which pictures are successively displayed on said display devices is set at every program under control of said control means, such that a still video picture display time t1 is shorter than a non-display time t2 in which a still picture video signal is not displayed, wherein 100t1<t2, and wherein said still picture video signal is a video signal representing step-by-step pictures each of which are different and are supplied to respective display devices and represent successive motions of a picture as seen from said moving vehicle.

21. The video display apparatus as claimed in claim 20, wherein said display device is a two-dimensional display device having light-emitting diodes arranged in a matrix fashion.

22. The video display apparatus as claimed in claim 20, wherein said display device is a transmission-type liquid-crystal display device, and said intermittent illumination device is a back-light.

23. The video display apparatus as claimed in claim 20, wherein said display device is a reflection-type liquid-crystal display device, and said intermittent illumination device is a strobe light.

24. A video display apparatus comprising:

a plurality of display devices positioned at predetermined intervals for viewing by passengers on a moving vehicle;

still picture video signal memory means for supplying a still picture video signal to said plurality of display devices;

control means for controlling said still picture video signal memory means; and an illumination device for intermittently displaying said plurality of display devices, wherein said still picture video signal memory means stores still picture video signals corresponding to a plurality of programs whose contents are different from each other, each of said programs stores data indicative of a display frequency relative to a display time period, and said control means controls the number of each of said programs displayed on said display devices in said display time period based on said display frequency data, and said control means further controls said illumination device such that a still picture video display time t1 is shorter than a non-display time t2 in which a still picture video signal is not displayed, wherein 100t1<t2, and wherein said still picture video signal is a video signal representing step-by-step pictures each of which are different and are supplied to respective display devices and represent successive motions of a picture as seen from said moving vehicle.

25. The video display apparatus as claimed in claim 24, wherein said still picture video signal memory means is a random-access memory.

26. The video display apparatus as claimed in claim 25, wherein said random-access memory is a semiconductor memory.

27. The video display apparatus as claimed in claim 25, wherein said random-access memory is one of an optical disk and a magnetic disk.

28. The video display apparatus as claimed in claim 24, wherein said display device is a two-dimensional display device having light-emitting diodes arranged in a matrix fashion.

29. The video display apparatus as claimed in claim 24, wherein said display device is a transmission-type liquid-crystal display device, and said intermittent illumination device is a back-light.

30. The video display apparatus as claimed in claim 29, wherein said back-light is a strobe light.

31. The video display apparatus as claimed in claim 24, wherein said display device is a reflection-type liquid-crystal display device, and said intermittent illumination device is a strobe light.

* * * * *